United States Patent [19]

Stackhouse

[11] 3,967,480

[45] July 6, 1976

[54] ROTARY RELEASE MAGNETICALLY OPERATED LOCK

[75] Inventor: Wells F. Stackhouse, Ashville, N.Y.

[73] Assignee: American Locker Company, Inc., Jamestown, N.Y.

[22] Filed: Mar. 19, 1975

[21] Appl. No.: 559,911

[52] U.S. Cl. ..... 70/276
[51] Int. Cl.[2] ..... E05B 47/00
[58] Field of Search ..... 70/276, 290, 413

[56] References Cited

UNITED STATES PATENTS

| | | | |
|---|---|---|---|
| 2,595,769 | 5/1952 | Cooley | 70/276 X |
| 3,056,276 | 10/1962 | Allander | 70/276 |
| 3,234,767 | 2/1966 | Allander | 70/276 |
| 3,395,555 | 8/1968 | Hickman | 70/276 X |
| 3,837,194 | 9/1974 | Fish | 70/276 |
| 3,837,195 | 9/1974 | Pelto | 70/276 |

*Primary Examiner*—Roy D. Frazier
*Assistant Examiner*—Terrell P. Lewis
*Attorney, Agent, or Firm*—Bean & Bean

[57] ABSTRACT

A lock includes pivotally supported tumbler pins having magnetically attractable ends normally disposed in one of several locked positions arranged along prescribed paths of travel, but movable under the influence of a key to assume combination setting or unlocked positions arranged along their paths of travel; and a tumbler pin end engaging plate rotatable between locked and unlocked positions when the tumbler pins are disposed in their combination setting positions.

10 Claims, 6 Drawing Figures

Fig. 1.
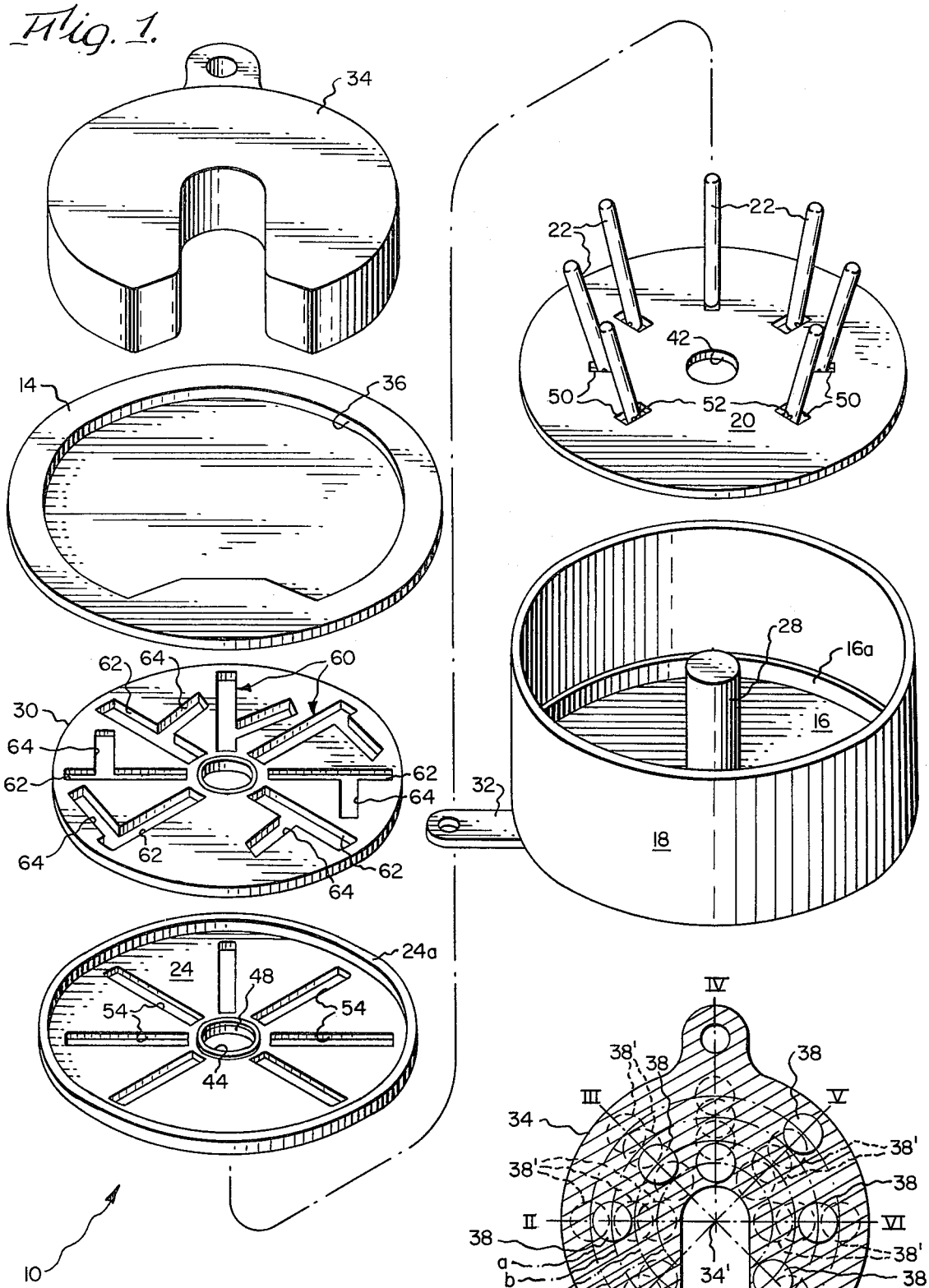
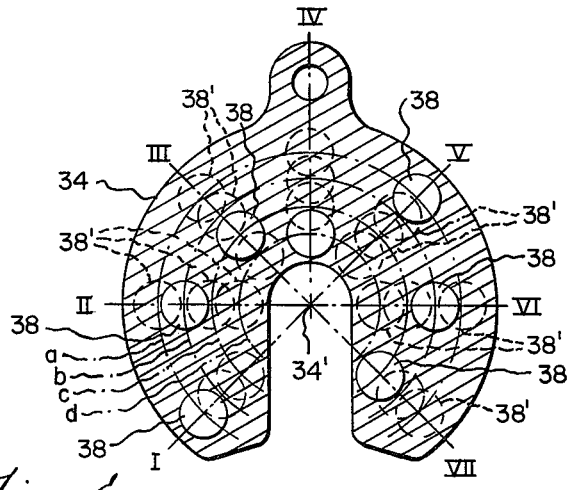
Fig. 6.

ROTARY RELEASE MAGNETICALLY OPERATED LOCK

SUMMARY OF THE INVENTION

The present invention generally relates to magnetically operated locks.

More specifically, the present invention is directed towards a magnetically operated lock, which is characterized as including a plurality of pivotally supported tumbler pins having magnetically attractable ends constrained for movement along the paths of travel directed essentially radially of a shaft. The shaft serves to rotatably support a release plate having a plurality of composite slots each of which is arranged in association with and adapted to receive the magnetically attractable end of one of the tumbler pins. Each composite slot includes a radially extending locking portion alignable with the path of travel of one of the tumbler pins and a transversely extending unlocking portion arranged to intersect the locking portion at a lock combination setting position arranged at some point other than adjacent the ends of the locking portion. The magnetically attractable ends of the tumbler pins normally engage with the side walls of the locking portions of the composite slots in order to prevent unlocking rotation of the release plate. When the ends of the tumbler pins are pivoted into their combination setting positions by the application of a magnetic key to the lock, the ends of the tumbler pins are disposed in alignment with the unlocking portions of the composite slots, thereby to free the release plate for unlocking rotational movement.

DRAWINGS

The nature and mode of operation of the present invention will now be more fully described in the following detailed description taken with the accompanying drawings wherein:

FIG. 1 is an exploded perspective view of a lock employing the present invention;

FIG. 6 is a sectional view of a magnetic key employed for controlling operation of the lock of the present invention.

DETAILED DESCRIPTION

Figure 2:
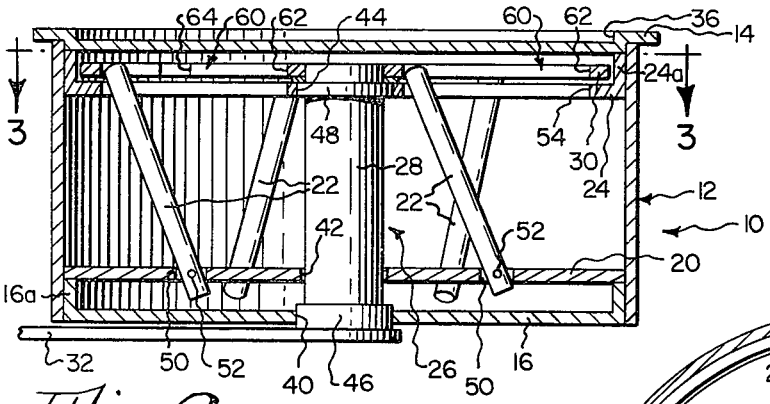
FIG. 2 is a vertical sectional view taken through an assembled lock, when in a locked condition.
Figure 4:
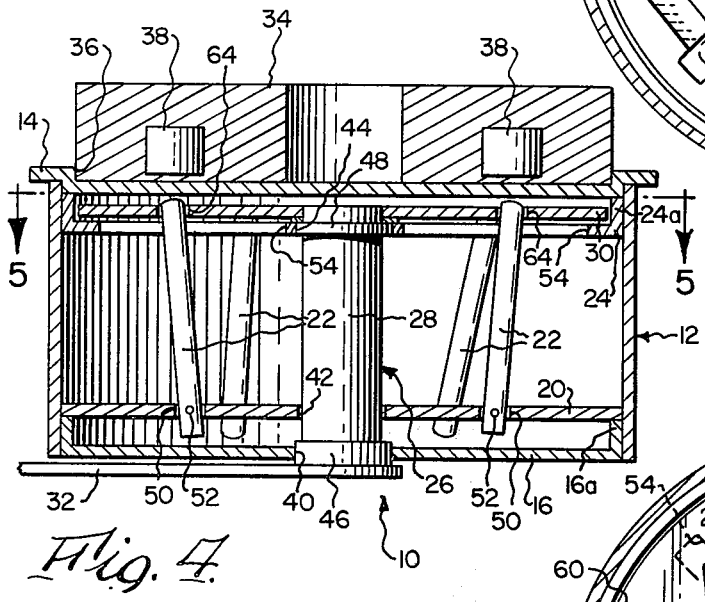
FIG. 4 is a sectional view similar to FIG. 2, but showing the lock in an unlocked condition.

A lock constructed in accordance with the present invention is generally designated as 10 in FIGS. 1, 2 and 4. More specifically, lock 10 comprises a lock casing or housing 12 defined by a face or front closure plate 14, a base or rear closure plate 16 and a cylindrical side wall part 18, which serves to rigidly interconnect plates 14 and 16 in a spaced, generally parallel relationship; a mounting plate 20 for pivotally supporting a plurality of tumbler pins 22; a tumbler pin guide plate 24; and a lock release assembly 26 including a supporting pin or shaft 28, a release plate 30 and an operator-release lever 32.

Figure 5:
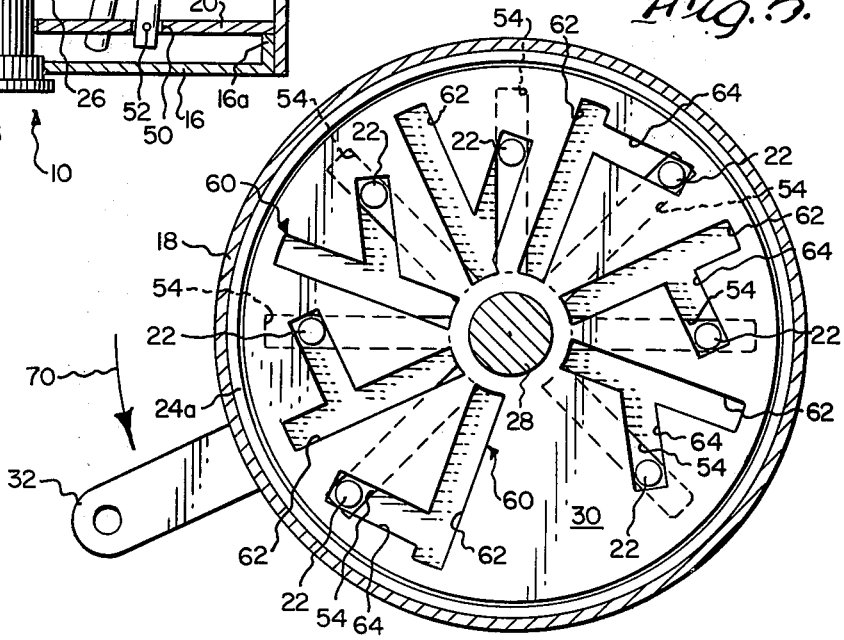
FIG. 5 is a sectional view taken generally along the line 5—5 in FIG. 4.

Lock 10 is adapted to be unlocked by means of a generally U-shaped key 34 removably insertable within a like configured key orienting recess 36 defined by face plate 14. A plurality of permanent magnets 38 are arranged within the nonmagnetic body of key 34 for the purpose of placing tumbler pins 22 in their respective combination setting positions when the key is inserted into recess 36, whereby to free assembly 26 for rotation between its locked and unlocked positions shown in FIGS. 3 and 5, respectively. The required placement of magnets 38 within key 34 will be determined by the internal structure of lock 10, as will hereinafter become apparent.

By reference to the drawings, it will be understood that mounting and guide plates 20 and 24 are positionally fixed in any suitable manner within lock casing 12, such that they are disposed relatively adjacent and essentially parallel to rear plate 16 and face plate 14, respectively. The spacing between mounting plate 20 and rear plate 16 may be suitably determined, as by forming the latter with a spacer sleeve **16*a*, whereas the spacing between face plate 14 and guide plate 24 may be suitably determined, as by forming the latter with a spacer sleeve 24*a*. The spacing between these several plates must be at least sufficient to permit free pivotal movements of the tumbler pins without engagement of their upper and lower ends with plates 14 and 16,** respectively.

Rear plate 16, mounting plate 20 and guide plate 24 are formed with vertically aligned and essentially centrally disposed through openings 40, 42 and 44, respectively, for rotatably receiving pin shaft 28. If desired, rotary and thrust bearing supports 46 and 48 for pin shaft 28 may be fitted within openings 40 and 44, respectively.

Figure 3:
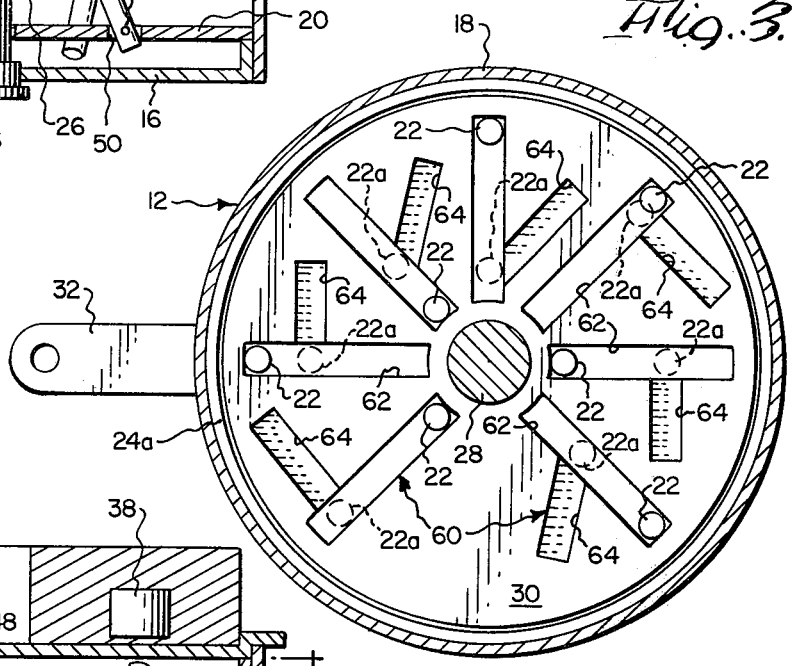
FIG. 3 is a sectional view taken generally along the line 3—3 in FIG. 2.

Referring to FIGS. 1–3, it will be understood that tumbler pins 22 preferably have their lower end portions pivotally secured within mounting plate openings 50 by any suitable means such as pin shafts 52 and have their upper or magnetically attractable end portions slideably received one in each of a plurality of guide slots 54, which are formed in guide plate 24 and arranged in vertical alignment with openings 50. With this arrangement, tumbler pins 22 are "top heavy" or unbalanced and therefore biased by the force of gravity to pivot within vertical planes extending essentially radially of the axis of rotation of pin shaft 28; the radially extending side walls of slots 54 serving to guidingly support or constrain the upper ends of the tumbler pins against movement transversely of their paths of travel. When guide plate 24 is viewed in plan, the upper end portions of pins 22 may be considered as undergoing reciprocating movements along straight line paths of travel.

Release plate 30, which is rigidly fixed to the upper end of pin shaft 28 intermediate face plate 14 and guide plate 24 is formed with a plurality of tumbler pin receiving composite slots 60 corresponding in number to the number of slots 54 formed in guide plate 24. Specifically, each of composite slots 60 includes an elongated radially extending locking slot portion 62, which is disposed in vertical alignment one with each of slots 54 when plate 30 is in its locked position shown in FIGS. 2 and 3, and an elongated, generally transversely extending unlocking slot portion 65, which is arranged to intersect its associated locking slot portion 62 at a tumbler pin combination setting position arranged at some point which is preferably other than immediately adjacent the opposite or radially inner and outer ends of locking slot portion 62. The unlocking slot portion 64 should be spaced from one or the other end of its associated locking slot portion 62 sufficiently to permit a side wall portion of the locking slot portion to be arranged for locking engagement with the upper end portion of its associated tumbler pin when the latter is in either of its rest-locked positions, such as may be defined by engagement thereof with the opposite ends of the locking slot portion and/or its associated slot 54. Preferably, the ends of slots 54 and 62 are disposed on radially directed opposite sides of their associated tumbler pin pivot axis, or on opposite sides of their associated tumbler pin when it vertically upstands, in order to permit the tumbler pins to "fall" under the influence of gravity randomly in opposite directions from a vertical upstanding position into either of two rest positions arranged on opposite sides of their combination setting positions along their respective paths of travel.

It will be appreciated that the possible number of combination setting positions for any tumbler pin of a given length and diameter is maximized by the illustrated construction, wherein such tumbler pin is pivotally supported immediately adjacent one of its ends and engages with release plate 30 immediately adjacent an opposite end.

Again referring to FIGS. 2 and 3, it will be seen that when lock 10 is locked or in a rest condition and assumes its illustrated vertically disposed position, the tumbler pins tend to be unbalanced and thus move away from a vertically upstanding position and fall in a random manner under the influence of gravity towards their rest positions arranged adjacent one or the other of the ends of vertically aligned slots 54 and 62. If lock 10 were to be used or installed in a position other than that illustrated in the drawings, eg., the lock installed such that the axis of pin shaft 28 extends horizontally, then the force of gravity would tend to move the tumbler pins such that each may assume only one rest position defined by one or the other ends of their associated slots 54. On the other hand, if lock 10 were to be inverted from the position shown in the drawings, the tumbler pins would tend to hang downwardly and would normally have their formerly upper ends disposed in rest positions intermediate the opposite ends of the slots. While this latter orientation of the lock is not preferred, it could of course be compensated for by insuring that unlocking slot portions 64 do not intersect locking slot portions 62 at tumbler pin combination setting positions, which would correspond to the single rest positions of the tumbler pins, if all were to assume a vertically disposed parallel relationship. Also, even in the case of a lock disposed in the position illustrated in the drawings, it would be possible to provide only one rest position for each tumbler pin as by radially shifting slots 54.

Thus, when lock 10 is in a locked condition, tumbler pins 22 are normally disposed in rest positions adjacent the opposite ends of locking slot portions 62 and out of alignment with unlocking slot portions 64. Accordingly, any attempt to rotate lever 32 will be resisted by engagement of the side walls of locking slot portions 62 with the upper end portions of tumbler pins 22. When key 34 is inserted within recess 36, the upper end portions of the tumbler pins are magnetically attracted and are thereby moved into their combination setting positions, which are designated as 22*a* in FIG. 3 and correspond to the points of intersection of their associated unlocking and locking slot portions 64 and 62. When this occurs, lever 32 and thus assembly 26 are freed for rotation in an unlocking direction indicated by arrow 70 in FIG. 5. During unlocking rotation of plate 30, the tumbler pins will move relatively within unlocking slot portions 64 until release plate rotation is arrested and the unlocked condition of the lock 10 thereby defined, such as for instance by engagement of the closed ends of unlocking slot portions 64 with the tumbler pins. During relative movement of the tumbler pins within unlocking slot portions 64, the illustrated configurations of such unlocking slot portions force the tumbler pins to move within guide plate slots 54 in a direction determined by the angle of intersection between the unlocking and locking slot portions.

For purposes of reference, a preferred lock design is shown in the drawings as being provided with seven identical tumbler pins 22, which are arranged to pivot within seven vertically disposed planes, wherein adjacent planes intersect one another at angles of essentially 45°. This arrangement requires that seven magnets 38 be encapsulated within key 34 and arranged one along each of seven radially extending imaginary lines designated as I–VII in FIG. 6; lines I–VII being orientated such that they will be disposed in vertical alignment with slots 54 when key 34 is inserted in recess 36. The positioning of magnets 38 lengthwise of lines I–VII will be such that each of the magnets is arranged to essentially overlie the junction or point of intersection of the locking and unlocking slot portions of an associated composite slot 60 when release plate 30 is in its locked position. To simplify manufacturing or combination setting procedures, each of magnets 38 is arranged in one of several possible positions, which are designated as 38′ in FIG. 6 and shown as being arranged at the intersections of radial lines I–VII and circles *a–d*. Circles *a–d* are disposed concentrically of the center 34′ of key 34, which is adapted to be disposed in alignment with the axis of shaft 28 when the key is fitted within recess 36. Thus, only one key, which has its magnets 38 arranged in the specific pattern illustrated in FIG. 6, will permit a release plate 30, which has the specific composite slot configuration illustrated in FIG. 3, to be rotated into unlocked position. If any one of magnets 38 were to be omitted or placed in one of the other possible magnet positions 38′, its associated tumbler would not be brought into its combination setting position and would thus be effective to prevent unlocking rotation of the release plate.

Lever 32, may if desired, be manually movable and coupled to a lock bolt, shackle or the like, not shown. Alternatively, lever 32 may be employed merely as a blocking element arranged to selectively interfere with the operation of a lock bolt, shackle or the like, which is under the control of a separate manually operable device, such as a push button, door knob, etc. Thus, the present invention is not restricted in applicability to the mechanism with which lever 32 is associated.

Further, it will be understood that the illustrated lock construction may be departed from in several ways without changing its overall mode of operation. Specifically, it is contemplated that spring devices or other suitable means may be employed either in cooperation with or in opposition to the force of gravity to bias the tumbler pins into their rest positions. Also, the tumbler pins may be pivotally supported at a point other than immediately adjacent their lower ends and/or the release plate may be arranged to engage portions of the tumbler pins disposed other than immediately adjacent their opposite ends and/or the portions of the tumbler pins subject to magnetic attraction and engaged with the release plate may be on opposite sides of the portion of the tumbler pins supported by pin shafts 52.

I claim:

1. In a lock the combination comprising:

a plurality of magnetically attractable tumbler pins supported for pivotal movement one within each of a plurality of planes arranged to extend essentially radially of an axis whereby a portion of each of said tumbler pins may move back and forth along a path of travel disposed essentially radially of said axis, said portion being normally biased towards at least one rest position disposed along its path of travel while being movable into a lock combination setting position spaced from said rest position; a lock release assembly including a release plate supported for rotary movements about said axis between locked and lock release positions, said release plate having a plurality of composite slots each of which is arranged to movably receive said portion of one of said tumbler pins, each of said composite slots including a locking slot portion and an unlocking slot portion, said locking slot portion extending radially of said axis in alignment with said path of travel of said portion of its associated tumbler pin when said release plate is in said locked position and engaging with said portion of its associated tumbler pin in all positions thereof excepting said combination setting position to prevent rotation of said release plate from said locked position towards said lock release position, said unlocking slot portion extending transversely of and intersecting its associated locking slot portion at a position therealong in alignment with said portion of its associated tumbler pin when the latter is in its combination setting position; and a key to be removably applied to said lock, said key having magnet devices corresponding in number to said tumbler pins and arranged within said key to attract said tumbler pins to effect movement of said portions thereof along their respective paths of travel from their rest positions into their combination setting positions when said key is applied to said lock, thereby to position said portions of said tumbler pins in alignment with their associated unlocking slot portions and free said release plate for rotation towards said lock release position.

2. A lock according to claim 1, wherein each of said tumbler pins is pivotally supported adjacent one end thereof and said portion of each said tumbler pin is arranged adjacent an opposite end thereof, and said key when applied to said lock having its magnet devices arranged to attract the opposite ends of said tumbler pins.

3. A lock according to claim 2, wherein said lock additionally includes a guide plate and a casing having a front closure plate recessed to positionally locate said key, a rear closure plate and a side wall part rigidly interconnecting said front and rear closure plates, said one and opposite ends of said tumbler pins being located relatively adjacent said rear and said front closure plates, respectively, said tumbler pins are supported by a supporting plate non-movably fixed within said casing, said release plate being located adjacent said front closure plate, said guide plate being non-movably fixed within said casing and located intermediate said release plate and said supporting plate, said guide plate having guide slots each arranged for receiving one of said tumbler pins and preventing movements of said portion thereof transversely of its path of travel; and said lock release assembly additionally includes a shaft and a lock operator release means, said release plate and said lock operator release means being fixed for rotation with opposite ends of said shaft, said shaft being supported for rotation about said axis relative to said casing and extending successively through said rear closure plate, said supporting plate and said guide plate.

4. A lock according to claim 3, wherein each of said tumbler pins is pivotally supported adjacent a lower end thereof, said portion of each said tumbler pin is arranged adjacent an upper end thereof, and said portion of each of said tumbler pins is normally biased by gravity to move towards one of a pair of rest positions arranged adjacent opposite ends of its path of travel, and said combination setting position of each said portion is disposed intermediate its rest positions.

5. In a lock, the combination comprising:

a plurality of magnetically attractable tumbler pins supported for movement one within each of a plurality of planes arranged to extend essentially radially of an axis whereby a portion of each of said tumbler pins may move back and forth along a path of travel disposed essentially radially of said axis, said portion being normally biased towards at least one rest position disposed along its path of travel while being movable into a lock combination setting position spaced from said rest position; a lock release assembly including a release plate supported for rotary movement about said axis between locked and lock release positions, said release plate having a plurality of composite slots each of which is arranged to movably receive said portion of an associated one of said tumbler pins, each of said composite slots including a locking slot portion and an unlocking slot portion, said locking slot portion extending radially of said axis and being arranged in alignment with said path of travel of said portion of its associate tumbler pin when said release plate is in said locked position and engaging with said portion of its associated tumbler pin in all positions thereof excepting said combination setting position for preventing movement of said release plate from said locked position towards said lock release position, said unlocking slot portion being arranged to extend transversely of said path of travel of said portion of its associated tumbler pin and intersecting said locking slot portion at a position in alignment with said portion of its associated tumbler pin when the latter is in its combination setting position; and a key to be removably applied to said lock, said key having magnet devices arranged to attract said tumbler pins for causing movement of said portions along their respective paths of travel from their rest positions into their combination setting positions when said key is applied to said lock thereby to position said portion of each of said tumbler pins in alignment with the unlocking slot portion of said composite slots with which they are associated for freeing said release plate for rotational movement towards said lock release position.

6. In a lock, the combination comprising:

a plurality of tumbler pins, each of said tumbler pins being pivotally supported for movement along a path of travel from at least one normal rest position into a combination setting position, said path of travel lying within a plane; guide means arranged to engage each of said tumbler pins intermediate its ends for constraining said tumbler pins from movements in a direction transversely of their respective paths of travel; a lock release assembly including a release plate supported for movement between locked and lock release positions, said release plate having a plurality of composite slots each of which is arranged to movably receive an associated one of said tumbler pins, each of said composite slots including a locking slot portion and an unlocking slot portion, said locking slot portion being arranged in alignment with said path of travel of its associate tumbler pin when said release plate is in said locked position and engaging with its associated tumbler pin in all positions thereof excepting said combination setting position for preventing movement of said release plate from said locked position towards said lock release position, said unlocking slot portion being arranged to extend transversely of said path of travel of its associated tumbler pin and intersecting said locking slot portion at a position in alignment with its associated tumbler pin when the latter is in its combination setting position; and a key to be removably applied to said lock, said key having magnet devices arranged to attract said tumbler pins for movement along their respective paths of travel from their rest positions into their combination setting positions when said key is applied to said lock thereby to position said tumbler pins in alignment with the unlocking slot portion of said composite slots with which they are associated for freeing said release plate for movement towards said lock release position.

7. In a lock, the combination comprising:

a plurality of tumbler pins, each of said tumbler pins being pivotally supported adjacent one end thereof for movement along a path of travel from at least one normal rest position into a combination setting position, said path of travel lying within a plane; a lock release assembly including a release plate supported for movement between locked and lock release positions, said release plate having a plurality of composite slots each of which is arranged to movably receive an opposite end of an associated one of said tumbler pins, each of said composite slots including a locking slot portion and an unlocking slot portion, said locking slot portion being arranged in alignment with said path of travel of its associate tumbler pin when said release plate is in said locked position and engaging with said opposite end of its associated tumbler pin in all positions thereof excepting said combination setting position for preventing movement of said release plate from said locked position towards said lock release position, said unlocking slot portion being arranged to extend transversely of said path of travel of its associated tumbler pin and intersecting said locking slot portion at a position in alignment with said opposite end of its associated tumbler pin when the latter is in its combination setting position; and a key to be removably applied to said lock, said key having magnet devices arranged to attract said tumbler pins for movement along their respective paths of travel from their rest positions into their combination setting positions when said key is applied to said lock thereby to position said opposite end of each of said tumbler pins in alignment with the unlocking slot portion of said composite slots with which they are associated for freeing said release plate for movement towards said lock release position.

8. A lock according to claim 7, wherein guide means are arranged to engage each of said tumbler pins intermediate the ends thereof in order to constrain said tumbler pins from movement in directions transversely of their respective paths of travel, and said key when applied to said lock having its magnet devices arranged to attract the opposite ends of said tumbler pins.

9. In a lock, the combination comprising:

a plurality of tumbler pins, each of said tumbler pins being pivotally supported adjacent a lower end portion thereof for pivotal movement along a path of travel arranged within a vertically disposed plane between a pair of rest positions disposed on opposite sides of a vertically upstanding position, each of said tumbler pins having a combination setting position disposed intermediate said rest positions and being normally biased into one of said rest positions; a lock release assembly including a release plate supported for movement between locked and lock release positions, said release plate having a plurality of composite slots each of which is arranged to movably receive an upper end of an associated one of said tumbler pins, each of said composite slots including a locking slot portion and an unlocking slot portion, said locking slot portion being arranged in alignment with said path of travel of its associate tumbler pin when said release plate is in said locked position and engaging with said upper end of its associated tumbler pin in all positions thereof excepting said combination setting position for preventing movement of said release plate from said locked position towards said lock release position, said unlocking slot portion being arranged to extend transversely of said path of travel of its associated tumbler pin and intersecting said locking slot portion at a position in alignment with said upper end of its associated tumbler pin when the latter is in its combination setting position; and a key to be removably applied to said lock, said key having magnet devices arranged to attract said tumbler pins for movement along their respective paths of travel from their rest positions into their combination setting positions when said key is applied to said lock thereby to position said upper end of each of said tumbler pins in alignment with the unlocking slot portion of said composite slots with which they are associated for freeing said release plate for movement towards said lock release position.

10. A lock according to claim 5, wherein each of said tumbler pins is pivotally supported adjacent an end disposed relatively remote from said portion thereof, guide means are arranged to engage each of said tumbler pins intermediate its said end and said portion for constraining said portion of each of said tumbler pins from movements in a direction transversely of their respective paths of travel, and said key when applied to said lock having its magnet devices arranged to attract said portion of each of said tumbler pins.

* * * * *